United States Patent [19]

Reichstadt

[11] 4,217,732

[45] Aug. 19, 1980

[54] ROOF WINDOW

[76] Inventor: Hans U. Reichstadt, Schwarzbachstrasse 41, 4020 Mettmann, Fed. Rep. of Germany

[21] Appl. No.: 948,163

[22] Filed: Oct. 3, 1978

[30] Foreign Application Priority Data

Oct. 7, 1977 [DE] Fed. Rep. of Germany ..... 2745192

[51] Int. Cl.[2] ..... E05D 15/48

[52] U.S. Cl. ..... 49/153; 49/253; 49/386

[58] Field of Search ..... 49/386, 246, 253, 390, 49/192, 153

[56] References Cited

U.S. PATENT DOCUMENTS

| | | | |
|---|---|---|---|
| 3,903,661 | 9/1975 | Gobel | 49/386 X |
| 4,055,024 | 10/1977 | Frank | 49/390 X |

FOREIGN PATENT DOCUMENTS

| | | | |
|---|---|---|---|
| 1172986 | 6/1964 | Fed. Rep. of Germany | 49/386 |
| 1708175 | 7/1967 | Fed. Rep. of Germany | 49/192 |

*Primary Examiner*—Kenneth Downey

*Attorney, Agent, or Firm*—Martin A. Farber

[57] ABSTRACT

A window of a residential roof with a window wing (a folding skylight shutter) which is supportably relieved of weight by an accumulator and which swings open about an upper axis of the blind window frame, the wing after decoupling additionally being able to be turned over about an axis lying substantially in the longitudinal center line, the axial pins of the last-mentioned axis being seated on carrier arms which are articulated in the vicinity of the upper transverse leg of the blind window frame and extend in the direction of the longitudinal legs of the blind window frame. The longitudinal legs of the window wing and the blind frame lie flushly aligned one above the other and the carrier arms including the accumulators which load the arms are arranged in the open angle or corner between the wing and the blind window frame, whereby the free ends of the carrier arms in the open position of the window wing are movable out to a distance with respect to the blind window frame, which distance corresponds approximately to half the length of the longitudinal leg of the wing.

14 Claims, 17 Drawing Figures

7
13
14
27
28
3
4
15
9
6
8
1
27
2
5
R 19
22
7
24
17
13
23
9
14
3
28
20
18
4
15
11
2
16
6
21
14'
27
10

27
14'
14
8
17
13
7
9
28
3
4
15

6
2
—R—
1
5

XII
XIII
2
3
6
9
10
29
30
31
32
33
34
35
36
37
38
39
40
46
47
48

ROOF WINDOW

The invention relates to a window of a residential roof with a window wing (a folding skylight shutter) which is supportably relieved or unloaded of weight by an accumulator and which swings open about an upper axis of the blind window frame, the wing after decoupling additionally being able to be turned over about an axis lying substantially in the longitudinal center line, the axial pins of the last-mentioned axis being seated on carrier arms which are articulated in the vicinity of the upper transverse leg of the blind window frame and extend in the direction of the longitudinal legs of the blind window frame.

With one development taken into consideration, the carrier arms form an intermediate frame which is foldable or tiltable about the horizontal longtudinal center line. The frame receives the window wing such that the lower intermediate frame section, which is pivotable relative to the upper intermediate frame section, is firmly connected with the window wing. If a circulation-ventilation is supposed to occur on such a window, the window wing is to be decoupled, after which the window wing is pivotable with respect to the upper intermediate frame section about the horizontal longitudinal center line. With small opening angles of the carrier arms and with a completely opened window wing, the latter projects disturbingly into the interior of the room forming the danger of injury. Moreover for sizing for a sufficient amount of light to penetrate, large dimensioned windows are required. Finally the construction of such a window is expensive in production.

It is an object of the invention to form a residential roof window of the previously set forth type in a technically simple manner of production for advantageous use, such that the size of the windowpane can correspond to the inner dimension of the blind window frame.

It is another object of the invention to provide a residential roof window of the introductory type, wherein the longitudinal legs (e.g., 9, 6) of the window wing (3) and the blind frame (2) lie flushly aligned one above the other and the carrier arms (14, 30) including the accumulators (15 and 34, respectively) which load the arms are arranged in the open angle between the wing (3) and the blind window frame (2), whereby the free ends of the carrier arms (14, 30) in the open position of the window wing (3) are movable or swingable out to a distance with respect to the blind window frame (2), which distance corresponds approximately to half the length of the longitudinal leg (9) of the wing and the lower transverse leg of the window wing can be swung into the open angle, the window wing being swingable substantially relative to the carrier arms only after release of a coupling.

Such type of development produces a window of a residential roof according to the introductory mentioned type, which in addition to a cost saving production brings advantages in use. The carrier arms now no longer need to form a special frame. The carrier arms are arranged such that the blind window frame and the frame of the wing can lie in alignment flush one above the other. Consequently it is possible for the size of the windowpane indeed to be able to correspond to the inner dimension of the blind window frame. This brings the advantage of permitting a large light penetration even with relatively small windows. The openings the roof itself can therefore be held smaller for the assembly of such windows of residential roofs, so that only a small loss in stability of the roof exists and that the reinforcements of the same can be formed less expensively, respectively. In the circulation-ventilation position the window wing no longer projects into the interior of the room and as a result no longer constitutes a danger of injury. Nevertheless the window in accordance with the invention permits a convenient cleaning position which allows, for example, the housewife, after adequate turning of the window wing, to be able to clean the outside of the windowpane easily from the inside of the room. It is possible to mount the carrier arms on the outer side of the window. The carrier arms can however also be arranged in the concealed position between the frame of the wings and the blind window frame.

An advantageous further formation according to the invention resides in that the carrier arms (14, 30) lie in chambers (10) of the longitudinal legs (9) of the wings, which chambers open rearwardly. An additional receiving space for the carrier arms in this manner can be done away with and is not necessary.

It proves favorable in accordance with the invention to form the accumulators (15) as compression springs, the accumulators swinging into the carrier arms (14), the latter being U-shaped opening downwardly. With respect to this the corresponding construction parts are emboxed telescopic-like one inside the other, the construction parts permiting a space saving formation. In the closed position of the window wing therefore the corresponding construction parts are completely covered.

Still there exists an advantageous feature according to the invention in that the compression springs (19) of the force accumulator are readjustable. The carrier arms can thus be continuously loaded such that they turn or swing sufficiently far for the purpose of turning of the window wing.

A space saving accommodation of the coupling device is realized in the manner that in the chamber profile (10) of the upper wing-transverse leg (7), which chamber profile opens rearwardly, the coupling bolts (22) are arranged to achieve a rigid unit between the carrier arms (14) and the frame (3) of the window wing. The coupling bolts can either be controlled individually or by a common actuation device.

Further an advantageous feature of the invention resides in that the axial pins (13) for the opening movement of the window wing (3) lie in front of the head side of the upper transverse leg (4) of the blind frame. In this manner these axial pins are drawn completely out of view from the interior of the room and do not impair the light penetration.

Another embodiment in accordance with the present invention is characterized in that the articulation point (29) of the carrier arms (30) likewise lies in the range of the open angle between the window wing (3) and the blind frame (2). As a result, all bearing positions are completely covered by the frame of the window wing, which increases the durability of the same.

It is of advantage that the angle apex end of the window wing (3) is decoupleably fastened to the blind window frame (2). The coupling connection, preferably for cleaning purposes is released or opened so that with a carrier arm which is swung out, the window wing can be reversed or turned over in order to be able to clean the outside of the windowpane from inside the room.

It is advantageous from a handling viewpoint for the decoupling to take place by means of a rod (46) which is able to be withdrawn or pulled back, the rearward end (46') of which enters into an opening (47) of an angle member (48) of the blind frame (2). As long as the rod is disposed in the opening of the angle member, the window wing swings about the articulation point which is formed by these parts. As soon as the rod leaves the opening of the angle, the window wing frame can be turned.

An advantageous control of the rods is achieved in the manner that the rods (46) are coupled with swingable exposing bars (42) of the window, such that a movement which is directed opposite to the opening swinging leads to a disengagement or release of the rod (46). The window exposing bars in this manner fulfill a double function in that their swinging is used to displace or shift the rods.

A further advantageous feature is realized in the manner that the rods (46) lie concealed in the profile of the window wing (3). The rods extend inside of the chambers in which the carrier arms also are accommodated.

Moreover beyond this it proves advantageous with the variation that the accumulators (34) are formed as tension springs which are arranged in the carrier arms (30). Their resiliency likewise permits variations. Preferably one of the ends of the tension spring is equipped with a nut, in which an adjustment spindle engages.

From a construction technical point of view it is favorable that one of the ends of the tension springs (35) are connected with small bearing lugs or blocks (31) of the carrier arm by means of cable lines (39).

Finally an advantageous feature of the invention is that the carrier arms (30) are able to be bent-off in their rearward range. In this manner it is possible to bring the frame for the window wing which is in the turned position (which serves for cleaning purposes) into a parallel position to the blind frame.

With the above and other objects and advantages in view, the present invention will become more clearly understood in connection with the following detailed description of a preferred embodiment, when considered with the accompanying drawings, of which:

Referring now to the first embodiment of FIGS. 1–8, the window 1 of the residential roof is coordinated to a residential room R under the roof. The window comprises the blind window frame 2, which frame lies in the slope or inclination of the roof, and the window wing frame 3, the latter being arranged flush in alignment with the frame 2.

Figure 1:
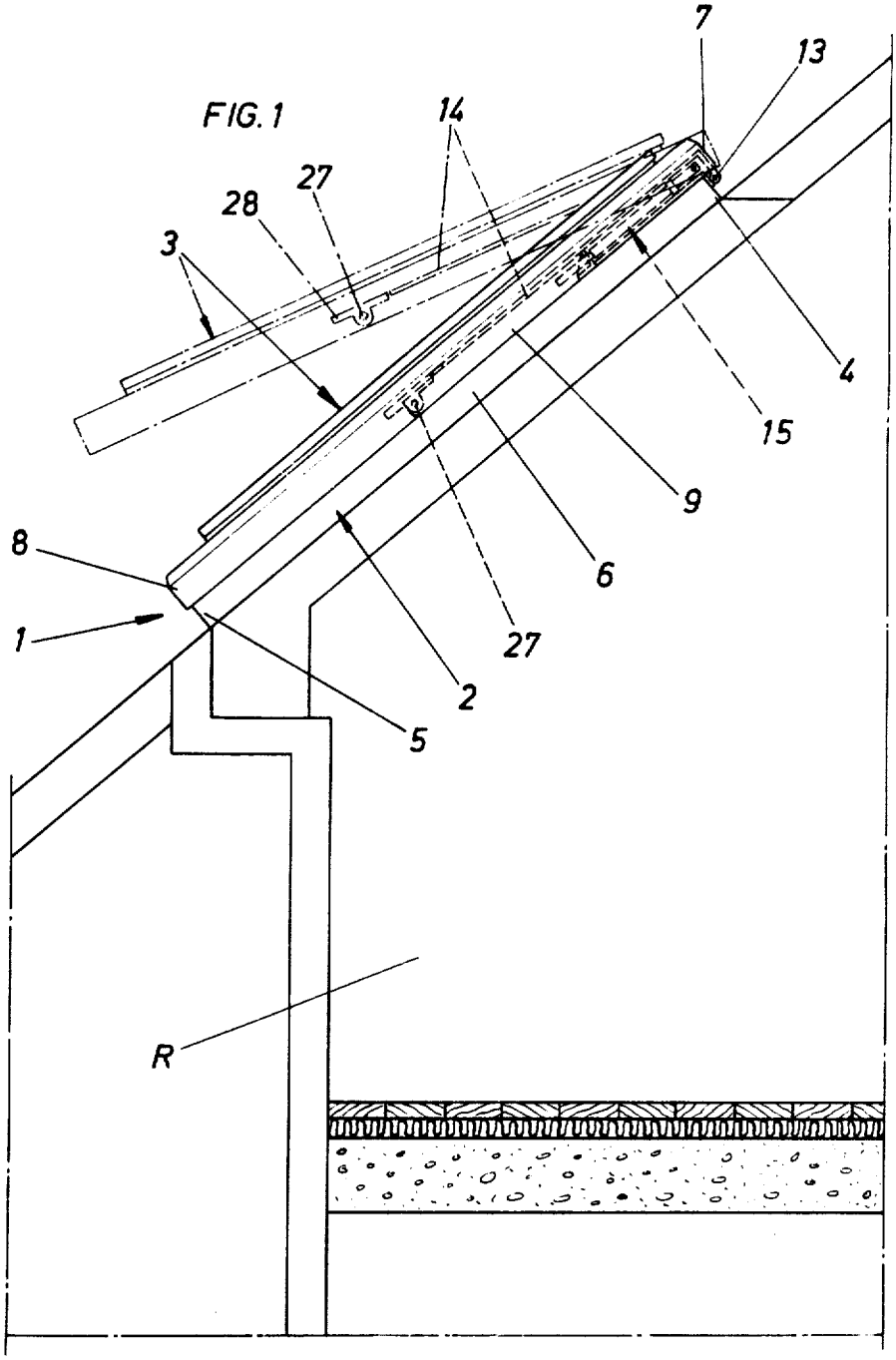
FIG. 1 is a side elevational view of a residential roof-window associated with a residential room under the roof, according to a first embodiment, in the closed position, the room being partially broken away.
Figure 3:
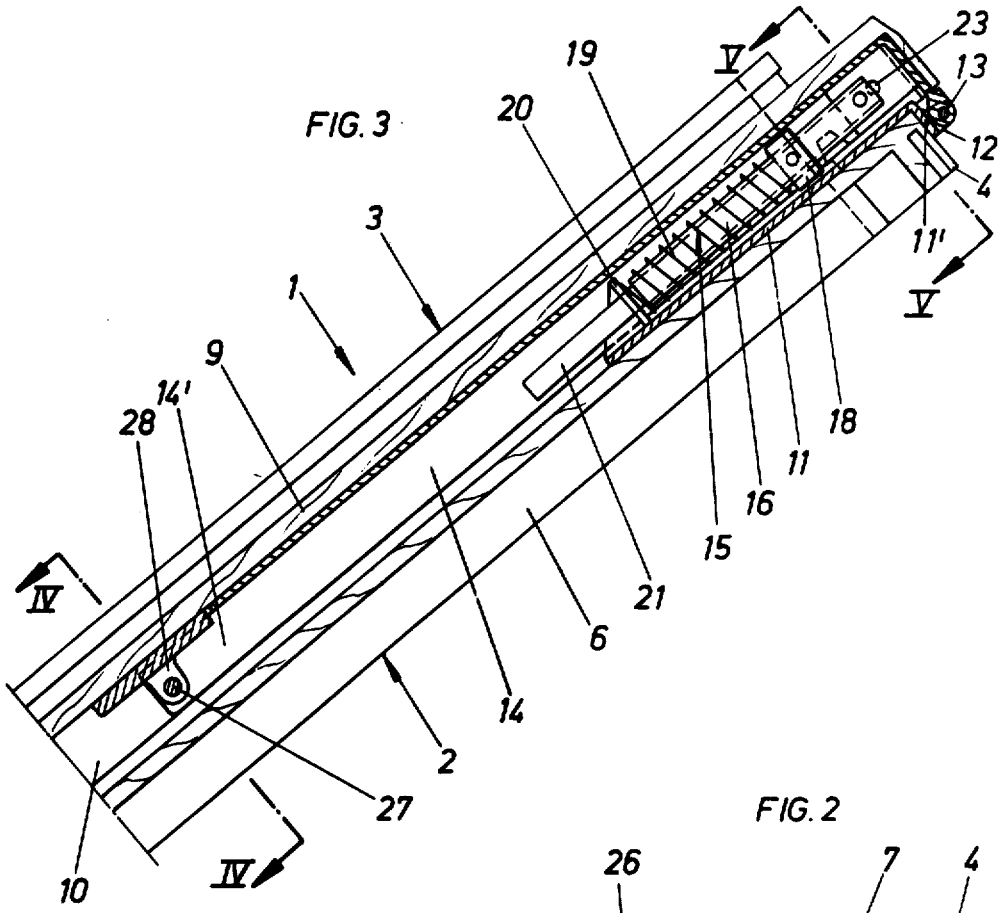
FIG. 3 is a section taken along the line III—III in FIG. 2 with a closed window wing.
Figure 2:
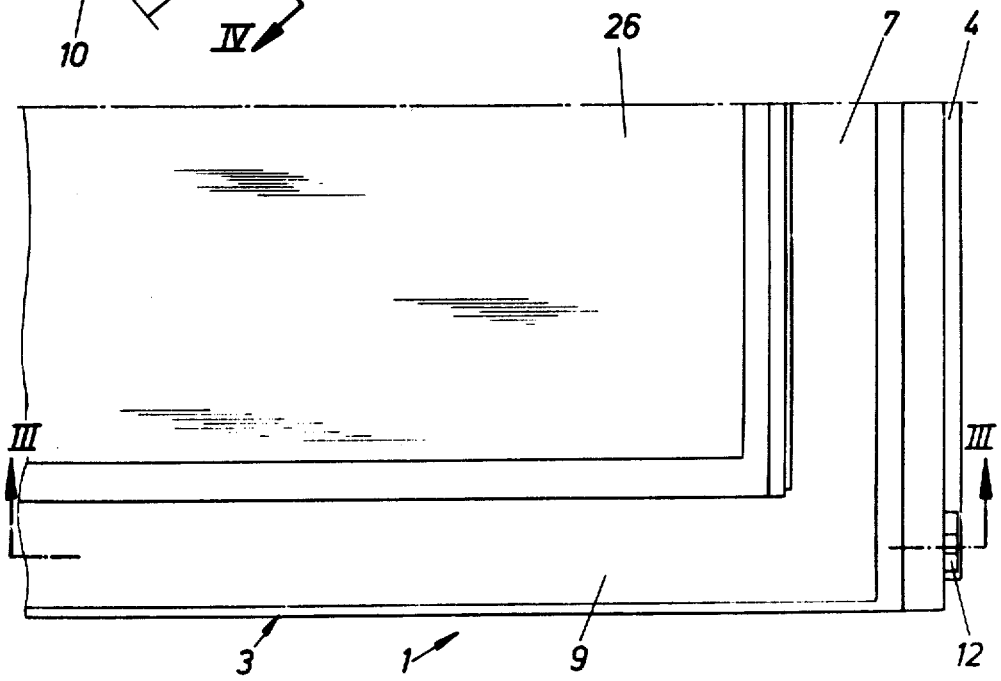
FIG. 2 is a partial plan view of the residential roof-window of FIG. 1.
Figure 4:
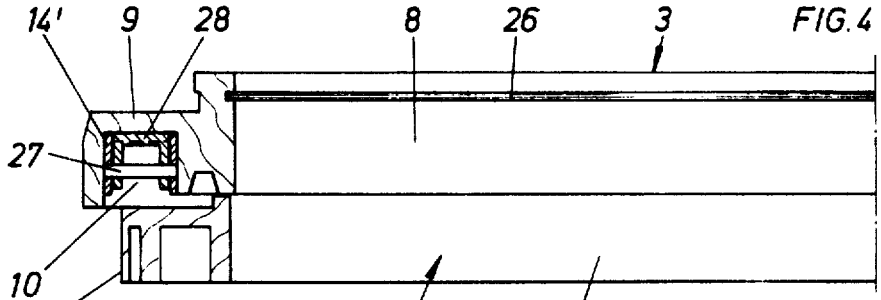
FIG. 4 is a section taken along the line IV—IV in FIG. 3.
Figure 5:
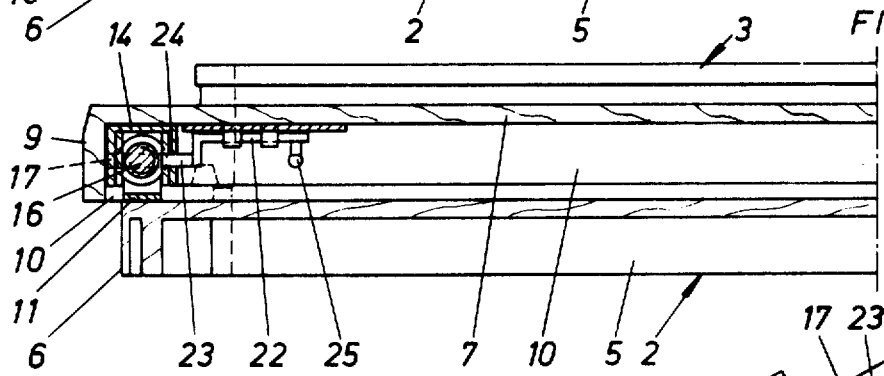
FIG. 5 is a section taken along the line V—V in FIG. 3.
Figure 6:
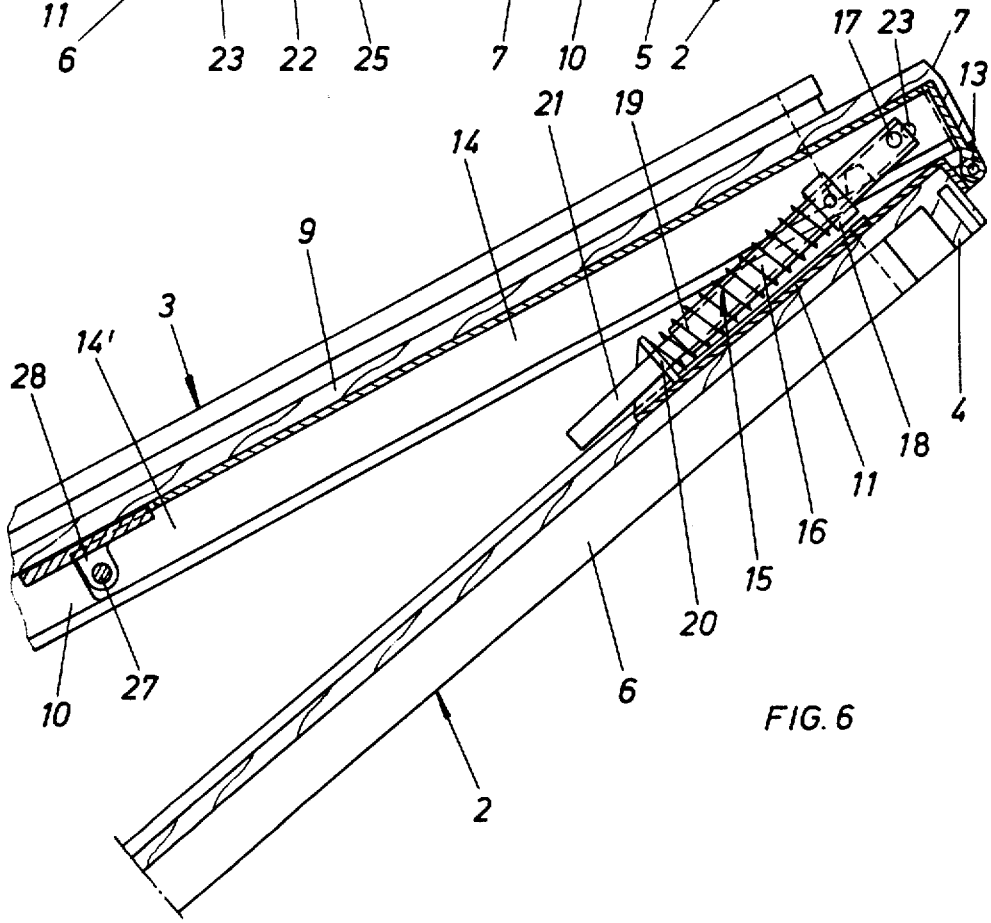
FIG. 6 is a section corresponding to FIG. 3 however with the set-out window wing.

The cross-sectional profile of the blind window frame 2 is illustrated particularly in FIGS. 4 and 5. The blind window frame 2 includes the transverse or cross-legs 4 and 5 which lie parallel to the gutter as well as the two longitudinal legs 6 which extend in the inclination of the roof.

The transverse legs of the frame of the window wing are designated with the numerals 7 and 8, whereas the longitudinal legs have the reference number 9. The longitudinal legs of the wing and the transverse legs of the wing form a chamber 10 on the rear side which runs therearound circumferentially.

Each longitudinal leg 6 of blind window frame on its upper end carries the angle or corner ledge 11, the shorter angle leg 11' of which extending in front of the head side of the upper transverse leg 4 of the blind window frame, carries the bearing eyes 12 for the axial or axis pin 13 of the carrier arm 14. The downwardly open U-profiled carrier arm 14 lies in the backwardly opening chamber 10 of the longitudinal leg 9 of the wing in the closed position of the window wing, compare particularly FIG. 3.

The force accumulator 15 which is formed as a compression spring acts at the upper end of the carrier arm 14. In particular, the accumulator 15 has a threaded spindle 16. The latter is mounted about the transverse pin 17 in the upper range or portion of the carrier arm 14. The adjustment nut 18 runs on the threaded spindle 16. One of the ends of the compression spring 19 is supported on the adjustment nut 18. The other end of the compression spring 19 steps against a stay 20, the latter extending from the angle ledge 11. The cross-sectionally set-off section 21 of the thread spindle 16 is inserted through the stay 20. The accumulator 15, as a consequence of its alignment, tends to pivot the carrier arm 14 about the axial pin 13 into the open position.

In the closed position of the window wing, the accumulator 15 which is arranged in the open angle or corner between the window wing and the blind window frame, is covered over by the U-shaped downwardly opening carrier arm 14. Two coupling bolts 22 which are arranged in the upper transverse leg 7 of the wing serve to form a rigid unit between the carrier arms 14 and the window wing 3. Each coupling bolt 22 is equipped with a pin 23, which engages in an opening 24 at the upper end of the carrier arm 14. The coupling bolt 22 at one end has an actuation handle 25. It is also possible however to provide a central handle for both coupling bolts in order to permit a synchronized or synchronous control of both of the locking bolts from one position.

With a closed window wing 3, the longitudinal legs 9 of the wing frame are flushly aligned with the longitudinal legs 6 of the blind window frame 2 as well as the transverse legs of the same. As illustrated in FIG. 4, the windowpane 26 thus can be exactly as large as the inner dimension of the blind window frame 2, so that with small windows of residential roofs a large light penetration is obtained.

An axial pin 27 is inserted through the free end 14' of each carrier arm 14. The axial pin engages in a small bearing block 28 which is secured on the longitudinal leg 9 of the window wing. The bearing block is arranged approximately in the longitudinal center line of the window wing.

The following manner of operation takes place: When bringing about the exposed position of the window wing 3, compare FIG. 6, the window wing 3, which is equipped with a gripping rod (not-illustrated) is swung together with the carrier arms 14 about the axial pins 13. The accumulator 15 aids or supports the opening movement. Since the window wing 3 and the carrier arms 14 are connected by means of the coupling bolts 22, they all form a rigid unit in this position.

Figure 7:
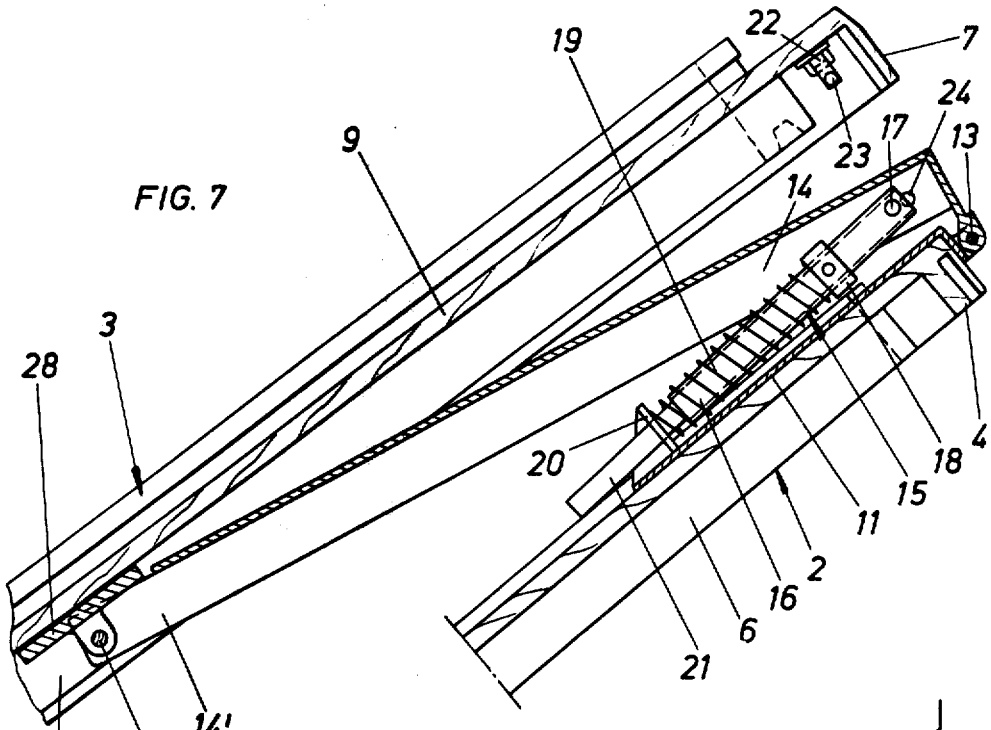
FIG. 7 is a section corresponding to FIG. 6, whereby after decoupling the window wing, the latter is swung into the circulation-ventilation position.
Figure 8:
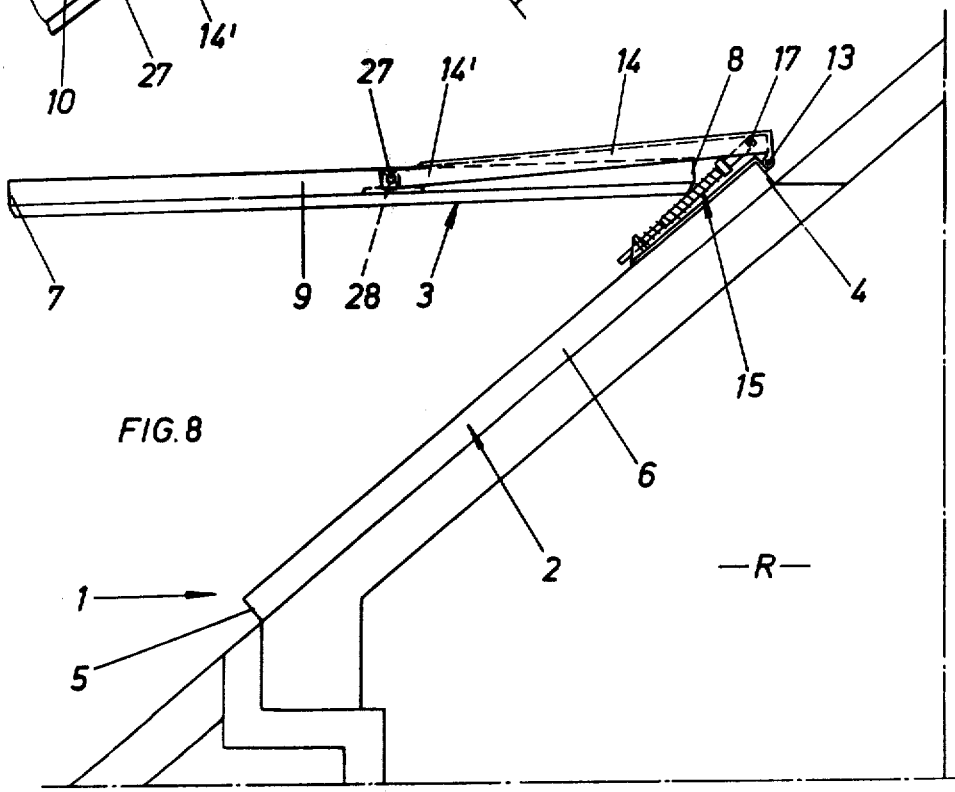
FIG. 8 is a view of the window wing brought into the cleaning position.

If the circulation-ventilation position according to FIG. 7 is supposed to be obtained, the coupling bolts 22 are to be pulled back. The pins 23 leave the carrier arms 14. Now the window wing 3 can pivot about the axial pins 27 which are located on the horizontal longitudinal center line of the window wing.

The cleaning position is obtained in the manner that, with the coupling bolts 22 brought out of engagement, the carrier arms 14 are moved or swung out by at least half the length of the longitudinal leg 9 of the wing. The swung out position which is reached, is held by the accumulator 15, so that the wing 3 is then turnable around the pins 27. After this, the carrier arms 14 can still swing a certain extent downwardly so that a convenient and easy cleaning of the outer side of the window wing can take place from the inside of the room.

Figures 11, 12, 13:
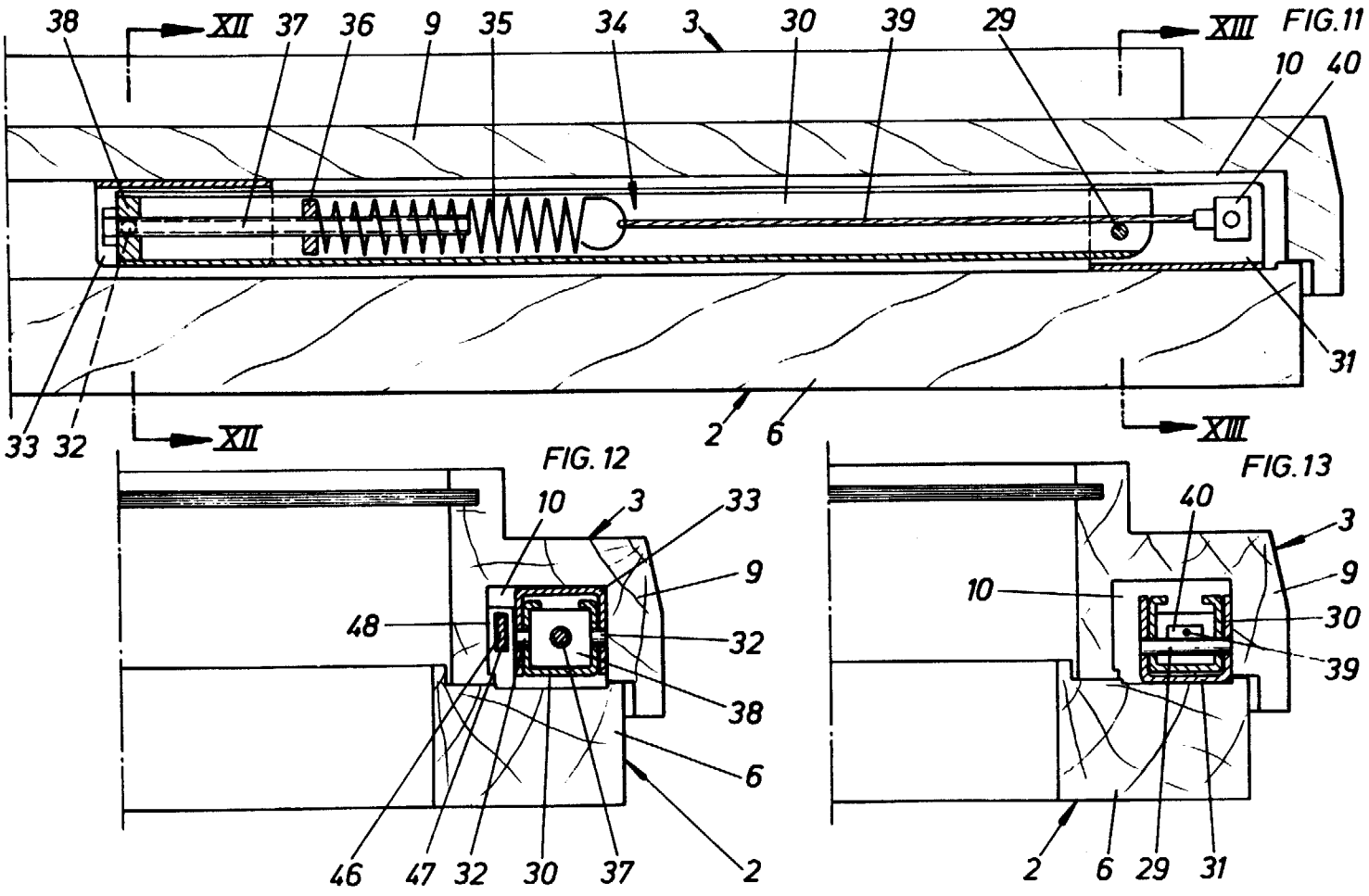
FIG. 11 is an enlarged longitudinal section through a longitudinal leg of the window of the residential roof.
FIG. 12 is a section taken along the line XII—XII of FIG. 11.
FIG. 13 is a section taken along the line XIII—XIII of FIG. 11.
Figure 14:
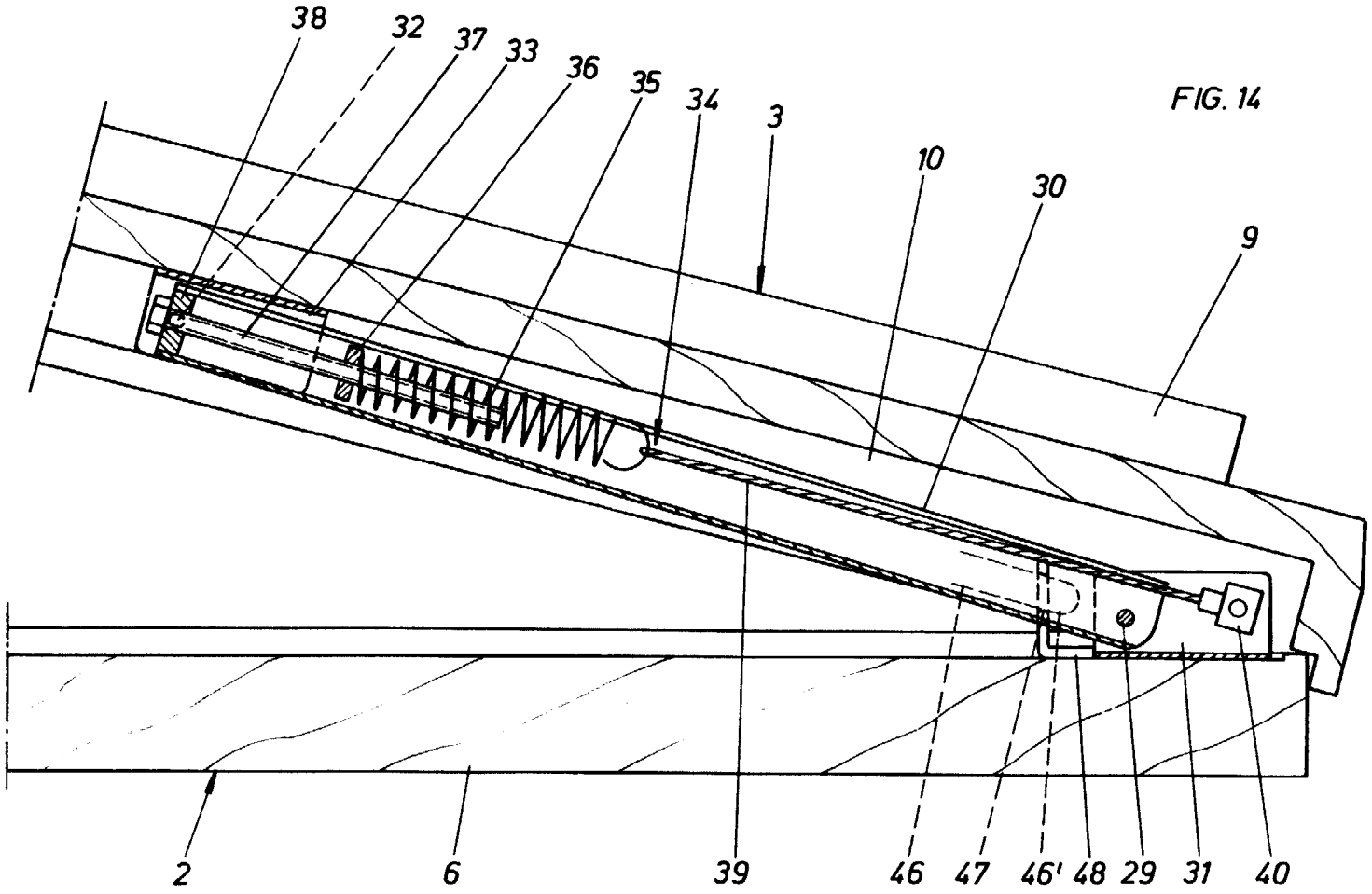
FIG. 14 is a longitudinal section corresponding to FIG. 11 whereby the window wing is swung into the set-out position.

With the second embodiment illustrated in FIGS. 9–15, the articulation point 29 of the carrier arm 30 likewise is located in the area of the open angle or corner between the window wing 3 and the blind window frame 2. For this purpose inside of the chamber 10 in the vicinity of the upper transverse leg of the window, a small bearing block 31 is fastened on the blind window frame 2. This forms the articulation point 29 about which the carrier arm 30 swings, the latter being C-profiled in cross-section. The other end of the carrier arm 30 is equipped with the transverse pins 32, which pins stand in engagement with the bearing block 33, the latter being fastened on the side of the window wing (FIG. 12).

The force accumulator 34 which is formed as a tension spring is arranged in the inside of the carrier arm 30. The accumulator 34 includes the tension spring 35, which tension spring carries the nut 36 on the end thereof which points to the window wing side bearing block 33. The threaded spindle 37, is inserted through the nut, the threaded spindle being screwed into another nut 38. The nut 38 is rigidly connected with the carrier arm 30, and the nut 38 forms the cross pins 32. A cable line 39 engages and acts on that end of the spring 35 which lies opposite to the nut 36 of the tension spring 35. The cable line 39 is connected with the cable clamp 40, the latter being arranged pivotally on the blind window frame side bearing block 31. The pivot points of the carrier arm 30 and of the cable clamp 40 lie at different heights so that the accumulator 34 biases the window wing in the sense of swinging open.

Closely in front of the lower transverse leg of the residential roof-window, window exposing bars 42 are mounted on the longitudinal legs 9 of the window wing-frame 3 about pins 41. The exposing bars 42 are provided with catch teeth 43, which teeth are able to be brought into engagement with locking bolts 44 mounted on the side of the blind frame. Each pin 41 is rigidly connected with the window-exposing bars 42 and projects into the chamber 10 of the window wing-frame and its longitudinal leg 9, respectively. There the pin 41 carries the guide rod 45 which is non-rotatably connected with the pin 41. The rod 45 engages and acts on a longitudinal rod 46, the latter extending in the longitudinal direction of the longitudinal leg 9. The rearward end 46' of the longitudinal rod 46 enters into an opening 47 of an angle member 48 of the blind window frame 2. Consequently the angle vertex end of the window wing 3 is decoupleably fastened to the blind window frame 2.

Figure 9:
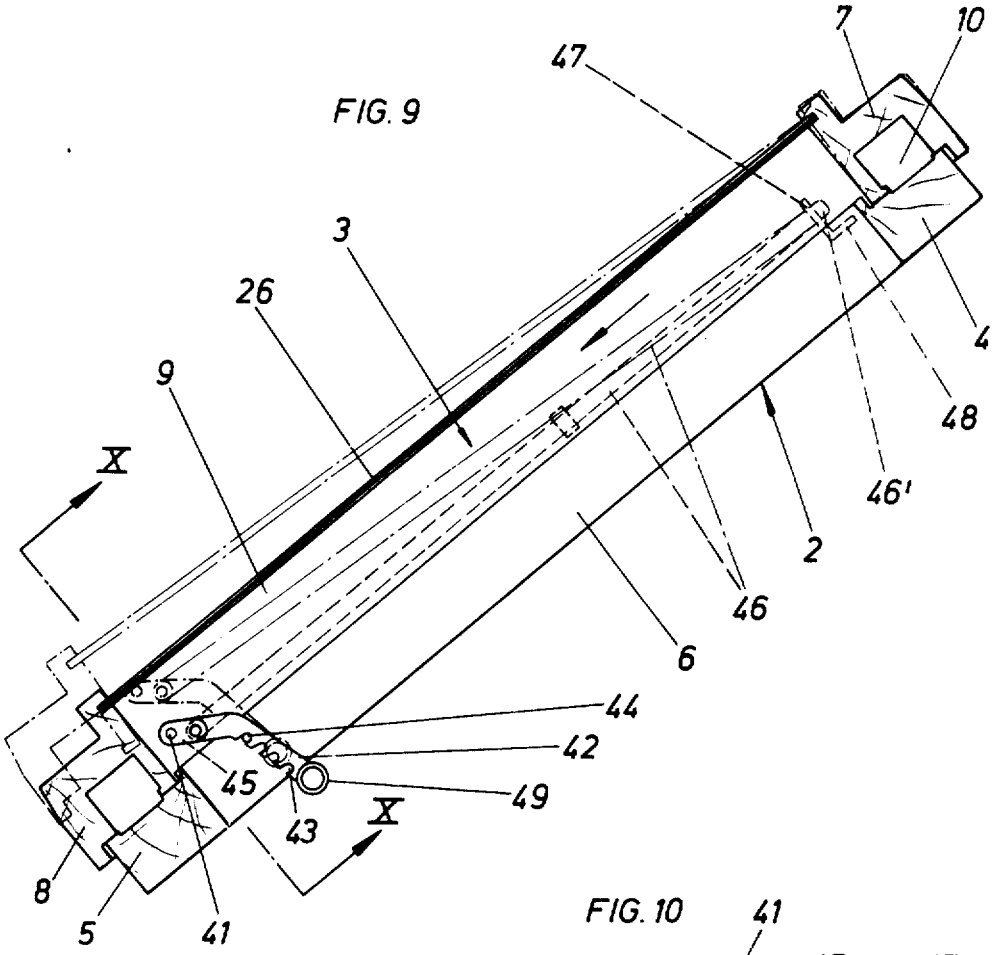
FIG. 9 is a longitudinal section through a residential roof-window according to a second embodiment.
Figure 10:
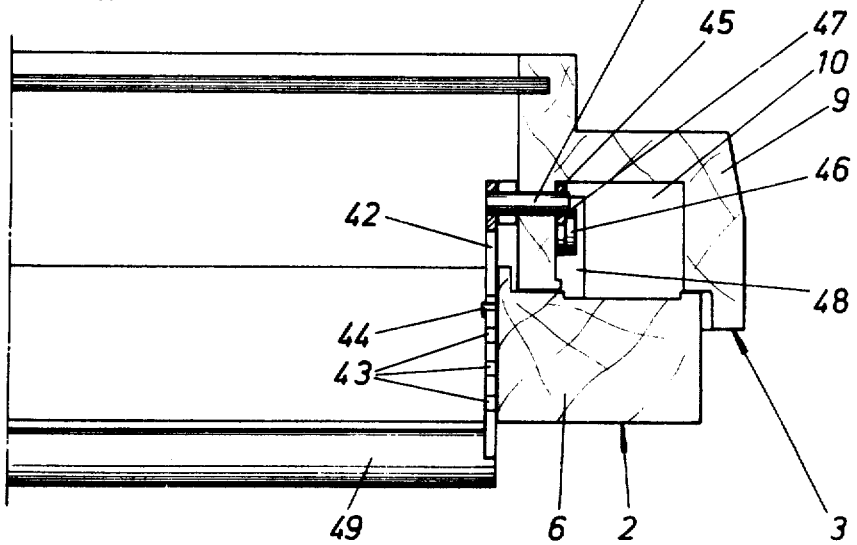
FIG. 10 is a section taken along the line X—X in FIG. 9.
Figure 15:
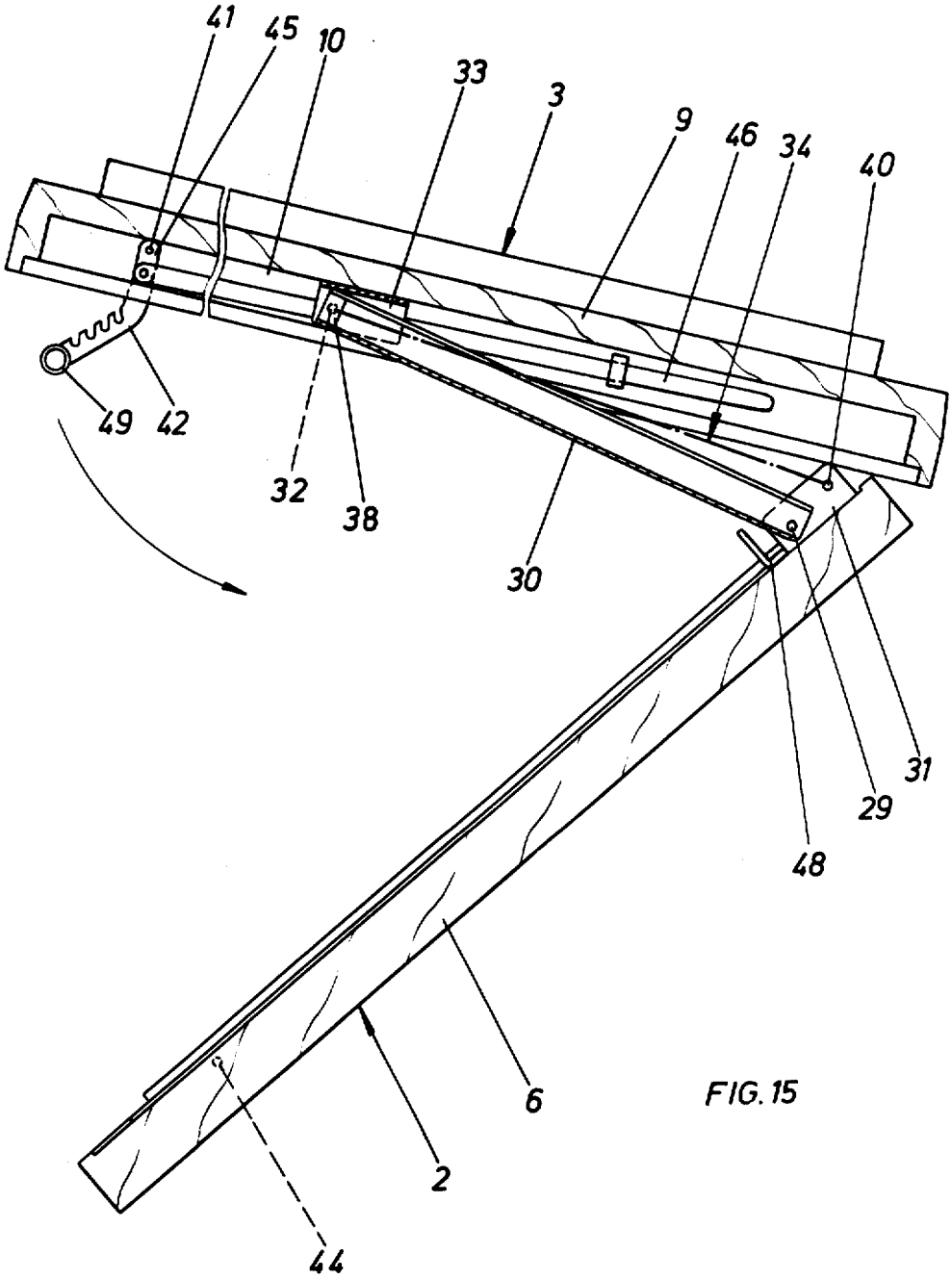
FIG. 15 is a longitudinal section through the residential roof-window in such a position of the carrier arms which position permits the window wing to be turned over in the direction of the arrow.

In FIG. 9 an exposed position of the window wing 3 is illustrated with dot-dash lines which is adjusted by the exposing bars 42. The exposing bars 42 are mutually connected to one another by a gripping rod 49. If the rods 46 are to be brought into the uncoupled position, the window wing has to be swung into such an exposed position so that thereafter the window exposing bars 42 can be shifted in a direction opposite to the opening swinging movement. In this manner by means of the guide rods 45, the rods 46, which are pivoted to the rods 45, are pulled in the direction of the arrow (FIG. 9), whereby their rearward ends 46' leave the openings 47 of the angles 48. From a position which is illustrated in FIG. 15, it is then possible to turn the window wing 3 in the direction indicated by the curved arrow into the cleaning position.

Figure 16:
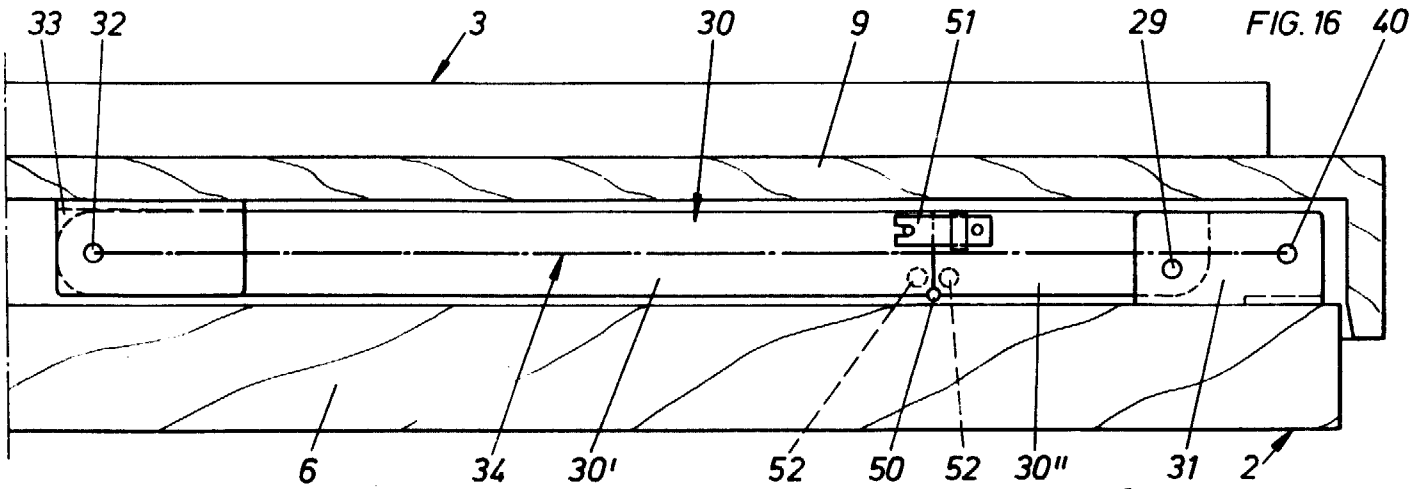
FIG. 16 is a longitudinal section through the residential roof-window according to a third embodiment, with carrier arms which are able to be angled or bent in the rearward range, according to the closed position of the window.
Figure 17:
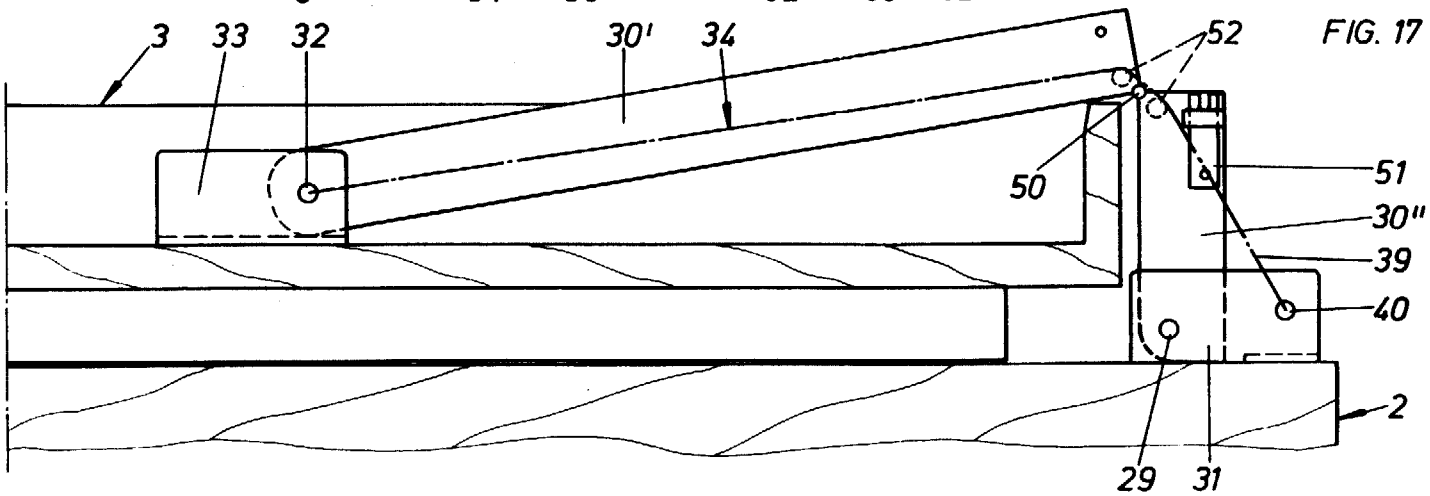
FIG. 17 is an illustration corresponding to FIG. 16, whereby the window wing has been brought into the turned over cleaning position.

With the third embodiment which is illustrated in FIGS. 16 and 17 (in which similar numerals represent similar parts of the previous embodiment), each guide rod 30 is formed in two parts comprising a longer section 30' and a shorter section 30''. The sections 30', 30'' are connected by a hinge joint 50 which faces the blind frame 2. The longer section 30' is mounted on the window wing sided block 33 and the shorter section 30'' is mounted on the bearing block 31 of the blind frame 2.

The extended position of the carrier arm 30 is secured by a shiftable lock bolt 51 cooperating with a pin on the other section, which bolt is displaced or shifted when one desires the cleaning position, thus the turned position of the window wing.

The deflection or reversing rollers or pulleys 52 for the accumulator 34 and its cable line 39 are adjacent to the pivot 50.

When the window wing 3 is brought into a corresponding exposed position, the coupling between the blind window frame and the frame of the window wing is released or terminated and thereafter the bolt 51 is released, then the window wing 3 can be swung into the position according to FIG. 17, whereby it lies parallel to the blind window frame 2. In this position the carrier arm 30 is bent, whereby the cable line of the accumulator 34 is supported on the deflection rollers 52. While I have disclosed several embodiments of the invention, it is to be understood that these embodiments are given by example only and not in a limiting sense.

I claim:

1. A roof window of a residential roof comprising a blind window frame adapted to be secured to a roof and defining an upper axis, said window frame having first longitudinal legs and a first upper and a first lower transverse leg connected together, carrier arms being articulated to said blind window frame at said upper axis in a vicinity of said upper transverse leg of said blind window frame and extending in the direction of said first longitudinal legs of said blind window frame, said blind window frame and said carrier arms constituting members, a window wing including second longitudinal legs and a second upper and a second lower transverse leg connected together, said window wing being pivotally mounted, about a central axis lying substantially in a longitudinal center line thereof, to said at least one means for decoupleably connecting said window wing at at least one decoupleable connection point to one of said members such that said window wing is swingable open about said upper axis of said blind window frame defining an open angle between said window wing and said blind window frame, and such that only after decoupling said means said window wing is swingable relative to said carrier arms about said central axis and said second lower transverse leg of said window wing is then tiltable into said open angle above said blind window frame and said window wing is free to be turned upside down, axial pins disposed at said central axis being seated on said carrier arms and pivotally connecting said window wing to said carrier arms, said longitudinal legs of said window wing and said blind window frame lie flushly aligned one above the other, at least one accumulator means for loading said carrier arms and operatively relieving said window wing of load, said carrier arms and said at least one accumulator means being disposed in the open angle between said window wing and said blind window frame, said carrier arms defining free ends, respectively, the free ends in an open position of said window wing being swingable out to a distance with respect to said blind window frame, which distance corresponds approximately to half the length of one of said second longitudinal legs of said window wing.

2. The roof window as set forth in claim 1, wherein said second longitudinal legs of said window wing define rearwardly opening chambers, said carrier arms are disposed in said chambers of said second longitudinal legs of said window wing.

3. The roof window as set forth in claim 1, wherein said at least one accumulator means includes a compression spring, said carrier arms are U-shaped opening downwardly, said at least one accumulator means pivots in said carrier arms, respectively.

4. The roof window as set forth in claim 1, wherein said second upper transverse leg in part defines a rearwardly opening chamber, means comprising detachable coupling bolts are arranged in said chamber for forming a rigid unit between said carrier arms and said window wing constituting said at least one means and said at least one decoupleable connection point.

5. The roof window as set forth in claim 1, wherein said first upper transverse leg defines a head side, additional axial pins pivotally connect said carrier arms to said blind window frame at said upper axis for exposure opening movement of said window wing, said additional axial pins lie in front of said head side of said first upper transverse leg of said blind window frame.

6. The roof window as set forth in claim 1, wherein said carrier arms are articulated to said blind window frame at respective articulation points which lie in the range of said open angle between said window wing and said blind window frame.

7. The roof window as set forth in claim 6, wherein said window wing has an end adjacent the vertex of the angle formed by said articulation points, said at least one means for decoupleably fixing said end of said window wing to said blind window frame constituting said at least one decoupleable connection point.

8. The roof window as set forth in claim 7, wherein said blind window frame has an angle formed with an opening, said at least one means includes withdrawable rod means for decoupling said window wing from said blind window frame at said at least one decoupleable connection point whereby said window wing is swingable about said central axis relative to said carrier arms, said rod means has a rearward end decoupleably inserted in said opening of said angle of said blind window frame yet such that said window wing is pivotal relative to said blind window frame with the rearward end inserted in said opening of said angle.

9. The roof window as set forth in claim 8, further comprising said at least one means further includes exposure bars pivotally connected to said window wing and releaseably engageable on said blind window frame constituting another of said at least one decoupleable connection point.

said rod means are coupled with said exposure bars such that a movement of said exposure bars which is directed opposite to an opening swinging of said exposure bars decouples said rod means from said angle, said opening swinging of said exposure bars decoupling the latter from said blind window frame.

10. The roof window as set forth in claim 9, wherein said rod means are concealed in the profile of said window wing.

11. The roof window as set forth in claim 1, wherein said at least one accumulator means is formed as a tension spring which is disposed in said carrier arms, respectively, operatively engaging said blind window frame and said window wing.

12. The roof window as set forth in claim 11 further comprising said carrier arms are articulated to said blind window frame at respectively articulation points which lie in the range of said open angle between said window wing and said blind window frame, bearing blocks secured to said blind window frame adjacent said first upper transverse leg, said articulation points are on said bearing blocks, said carrier arms articulated to said bearing blocks, respectively, cable lines connect one of the ends of said tension springs with said bearing blocks, respectively at other points on said bearing blocks such that said cable lines pass above said articulation points.

13. The roof window as set forth in claim 1, wherein said carrier arms are each formed in two parts, said two parts are pivotally connected together in a rearward portion of said carrier arms, whereby the latter are able to be bent in said rearward portion.

14. The roof window as set forth in claim 1, wherein said at least one accumulator means constitutes two accumulators at least pivotally connected to said carrier arms, respectively, and to said blind window frame.

* * * * *